US007086581B1

(12) United States Patent
Lackey et al.

(10) Patent No.: US 7,086,581 B1
(45) Date of Patent: Aug. 8, 2006

(54) REINFORCED PLASTIC MAILBOX

(75) Inventors: Robert W. Lackey, Hickory, NC (US); Robert C. Beckmann, Vail, NC (US)

(73) Assignee: RWL Corporation, Hickory, NC (US)

( * ) Notice: Subject to any disclaimer, the term of this patent is extended or adjusted under 35 U.S.C. 154(b) by 0 days.

(21) Appl. No.: 11/052,591

(22) Filed: Feb. 7, 2005

(51) Int. Cl.
*A47B 97/08* (2006.01)

(52) U.S. Cl. ..... 232/1 C; 232/17; 232/38

(58) Field of Classification Search ..... 232/1 C, 232/17, 45, 38; D99/29–32
See application file for complete search history.

(56) References Cited

U.S. PATENT DOCUMENTS

| | | | | | |
|---|---|---|---|---|---|
| 2,120,857 | A | * | 6/1938 | Crawford et al. | 232/33 |
| D221,361 | S | * | 8/1971 | Parker | D99/29 |
| 3,888,409 | A | * | 6/1975 | Bolduc | 232/1 C |
| 4,146,171 | A | * | 3/1979 | Hodge | 232/1 C |
| 5,119,986 | A | * | 6/1992 | Kobilarcik et al. | 232/35 |
| D335,750 | S | * | 5/1993 | Berardi | D99/31 |
| 5,465,902 | A | * | 11/1995 | Hanson | 232/33 |
| 5,664,729 | A | * | 9/1997 | Ladewig | 232/39 |
| D385,680 | S | * | 10/1997 | Cacciola et al. | D99/29 |
| 5,775,578 | A | * | 7/1998 | Baxi et al. | 232/17 |
| D488,908 | S | * | 4/2004 | Hradisky | D99/29 |
| D489,159 | S | * | 4/2004 | Hradisky | D99/29 |
| D489,160 | S | * | 4/2004 | Hradisky | D99/29 |
| D497,465 | S | * | 10/2004 | Hradisky | D99/29 |
| D499,225 | S | * | 11/2004 | Taylor et al. | D99/32 |
| D501,594 | S | * | 2/2005 | Taylor et al. | D99/29 |
| D503,504 | S | * | 3/2005 | Taylor et al. | D99/29 |
| D503,844 | S | * | 4/2005 | Taylor et al. | D99/32 |
| 2005/0184142 | A1 | * | 8/2005 | Brown | 232/17 |

* cited by examiner

*Primary Examiner*—William L. Miller
(74) *Attorney, Agent, or Firm*—Charles L. Schwab; Nexsen Pruet, LLC

(57) ABSTRACT

A plastic mailbox has a postal compartment mounted on top of a newspaper compartment which in turn is mounted on the top of a two piece upright plastic support. The laterally opposite side wall structures and arched top structure of the postal compartment and the laterally opposite side wall structures and the bottom structure of the newspaper compartment have inner and outer walls for strength. The postal compartment is strengthened by a pair of longitudinally extending rows of upward bulges or pockets in the arched ceiling segment of the inner wall of its arched top structure. The postal compartment and newspaper compartment are further strengthened by a forward projecting lip encircling forward end of the mailbox. A partial wall at the rear of the newspaper compartment serves as a newspaper stop and as a reinforcing structure.

4 Claims, 4 Drawing Sheets

43
18
41
42
47
46

43
18
51
53
48
54
52
41
42
47
46

REINFORCED PLASTIC MAILBOX

CROSS-REFERENCE TO RELATED APPLICATIONS

Applicants have the following pending United States patent applications on related subject matters:

Ser. No. 11/024,265 filed Dec. 28, 2004 for a Ground Mount Post;

Ser. No. 11/032,094 filed Jan. 11, 2005 for a Mailbox and Support;

Ser. No. 11/047,977 filed Feb. 1, 2005 for a Mailbox with Signal;

Ser. No. 11/047,976 filed Feb. 1, 2005 for a Multiple Component Mailbox having Postal and Newspaper Compartments;

Ser. No. 11/042,280 filed Jan. 25, 2005 for a Mailbox Door with Rain Intercepting Structure.

BACKGROUND OF THE INVENTION

In order to gain approval of the United States Postal Service a mailbox must comply with certain specifications including withstanding impact tests. A wide variety of mailboxes are being marketed including metal and plastic mailboxes. In order to minimize weight and material expense, a two wall plastic construction may be used. A brittle rigid plastic would shatter when subjected to an impact test and therefore a flexible resilient plastic is preferred. In addition to the need to pass the tests of the U.S. Postal Service, to obtain its approval, it is desirable to provide a mailbox which will withstand abuse by pranksters or vandals who may use baseball bats.

SUMMARY OF THE INVENTION

A plastic mailbox includes a double walled postal compartment having a door, a double walled newspaper compartment beneath the postal compartment and a vertical support with a hollow interior adapted to receive an upright support post set in the ground. The top and sides of the postal compartment are formed by an inner wall and an outer wall spaced outwardly from the inner wall. The sides and bottom of the newspaper compartment are likewise defined by inner and outer walls. A partial rear wall in the newspaper compartment serves as a newspaper stop. The inner wall of the postal compartment has a ceiling part, which is reinforced by a plurality of longitudinally spaced bulges formed therein. The front portions of the postal and newspaper compartments have a stepped construction producing a forwardly projection rim.

BRIEF DESCRIPTION OF THE DRAWINGS

One embodiment of the invention is illustrated in the accompanying drawings, in which.

DETAIL AND DESCRIPTION OF THE INVENTION

Figure 1:
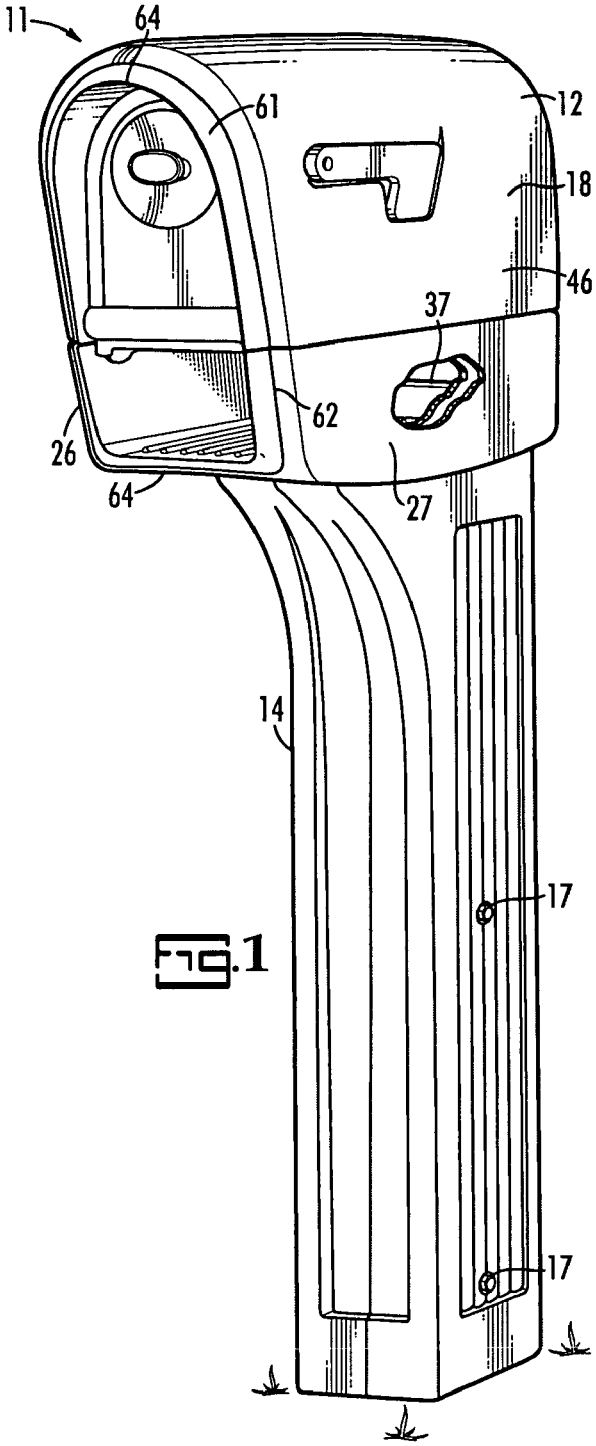
FIG. 1 is a perspective view of a plastic mailbox with parts broken away for illustration purposes.
Figure 2:
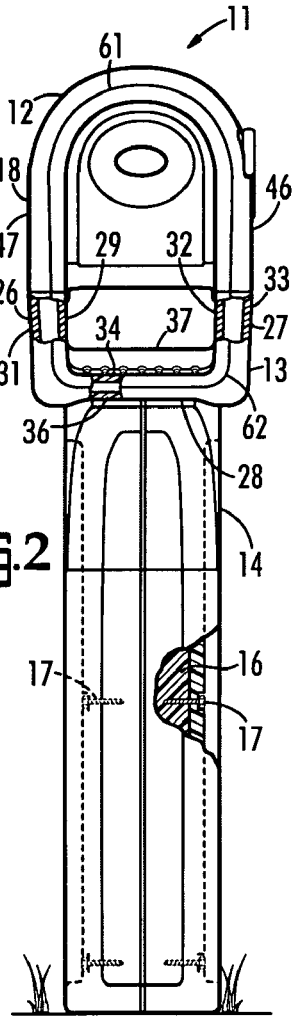
FIG. 2 is a front view of the mailbox of FIG. 1 with parts broken away for illustration purposes.
Figure 3:
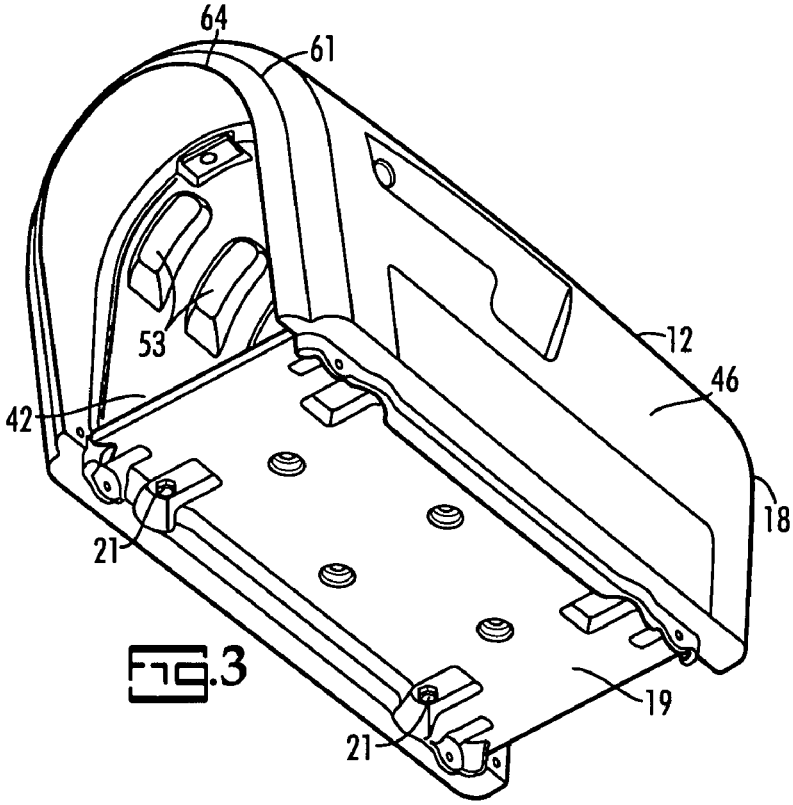
FIG. 3 is a perspective view of the postal compartment of the mailbox.
Figure 4:
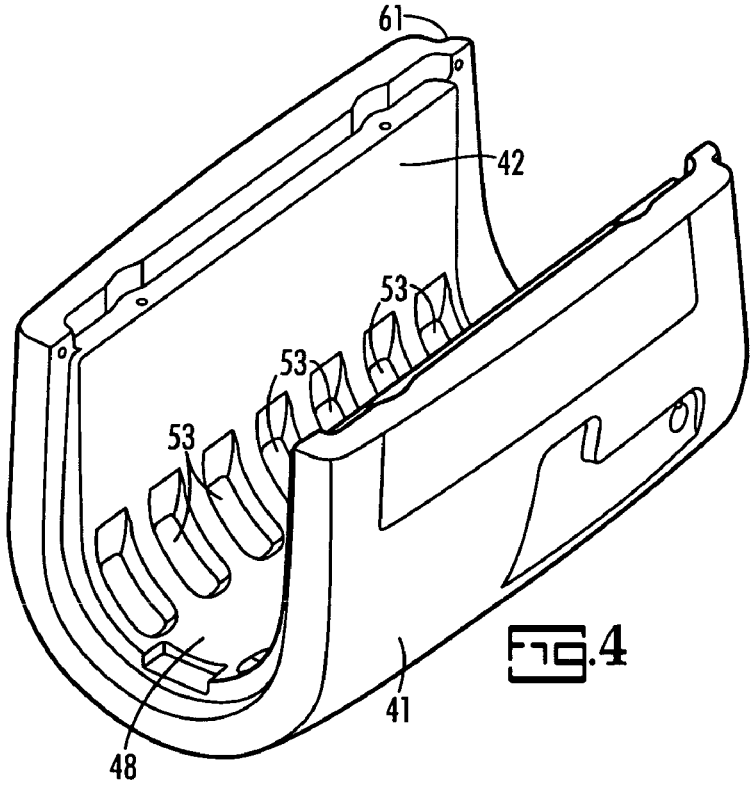
FIG. 4 is a perspective view of a housing component of the postal compartment.
Figure 5:
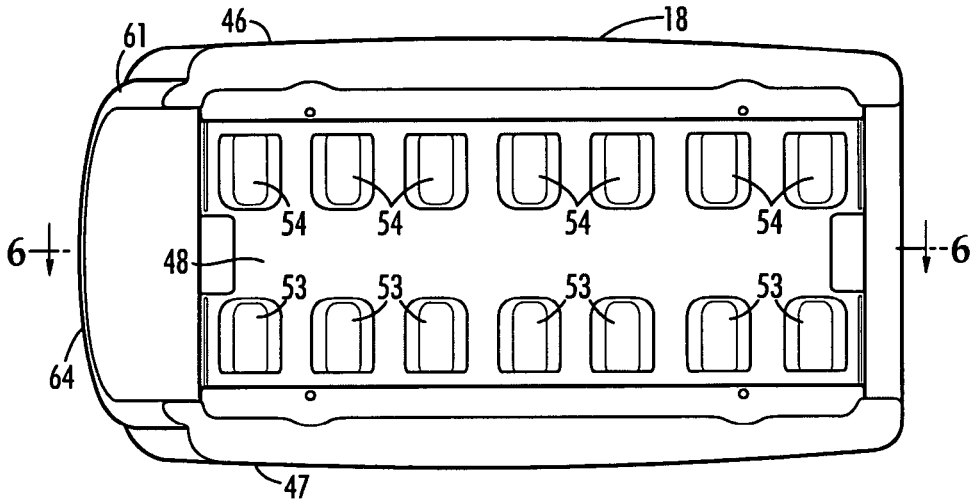
FIG. 5 is a bottom view of the housing component of the postal compartment.
Figure 6:
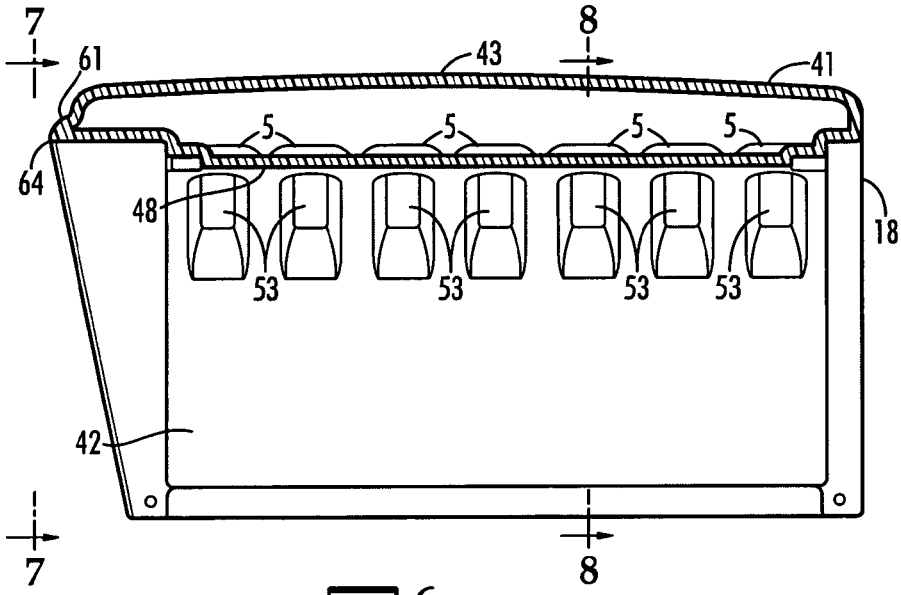
FIG. 6 is a section taken on line 6—6 in FIG. 5.
Figure 7:
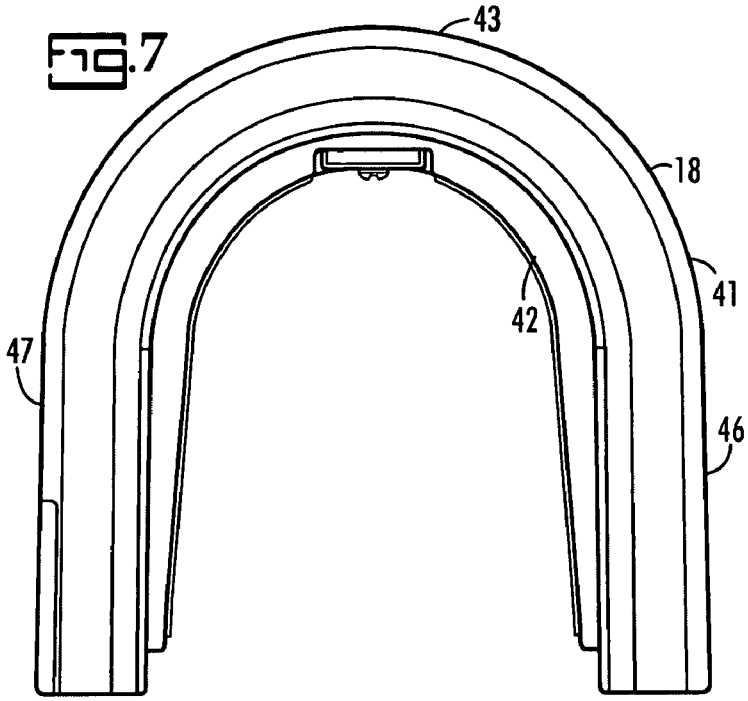
FIG. 7 is a front view of the housing component of the postal compartment taken on line 7—7 of FIG. 6.
Figure 8:
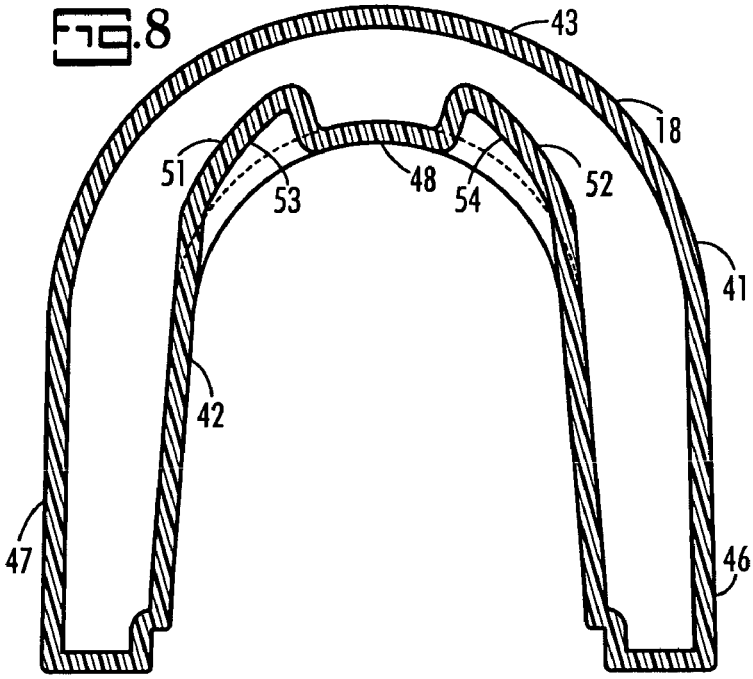
FIG. 8 is a section taken on the line 8—8 in FIG. 6.

The plastic mailbox 11 illustrated in FIGS. 1 and 2 includes a postal compartment 12, a newspaper compartment 13 and a two piece support 14 attached to the underside of the newspaper compartment 13. The support 14 is secured to a wooden mounting post 16 by screws 17. As shown in FIG. 3, the postal compartment 12 includes a housing component 18 and a floor 19 secured to the housing component 18 by four screws 21, only two of which are shown. As shown in FIG. 2, the newspaper compartment 13 has a pair of laterally spaced side wall structures 26, 27 and a bottom structure 28. Side wall structure 26 includes an inner wall 29 and an outer wall 31 and side wall structure 27 includes an inner wall 32 and an outer wall 33. The bottom wall structure 28 includes a horizontal inner wall 34 and a horizontal outer wall 36 spaced vertically below the inner wall 34. A partial rear wall 37 at the rear of the newspaper compartment 13 serves as a stop for newspapers inserted into the newspaper compartment 13 by a newspaper carrier. The partial rear wall 37 also strengthens the newspaper compartment 13.

Referring to FIGS. 3 though 8 the postal compartment 12 has a longitudinally extending double walled arched roof structure 43 and double wall side wall structures 46, 47 formed by an outer wall 41 and on the inner wall 42. The outer and inner walls 41, 42 each have laterally spaced upright segments and an arched segment between the upper ends of the upright segments. An arched ceiling 48 segment of the inner wall 42 has a pair of longitudinally extending parallel rows of upwardly extending and spaced pockets or bulges 51, 52 forming longitudinally extending parallel rows of equally spaced pockets 53, 54. The upwardly extending pockets 51, 52 provide rigidity and strength to the ceiling segment 48 of the inner wall 42 and thus afford resistance to downward deflection of the roof structure 43 of the postal compartment 18 should it happen to be impacted.

The postal compartment 12 and the newspaper compartment 13 are strengthened at their front ends by formation of a shoulder 61 at the forward end of the outer wall 41 of the postal compartment housing 18 and by formation of a shoulder 62 at the front end of the newspaper compartment 13. The shoulders 61, 62 define a forwardly projecting reinforcing lip 64 encircling the front of the postal and newspaper compartments 12, 13. The lip 64 projects forwardly from the top and side wall structures 43, 46, 47 of the postal compartment 12 and projects forwardly from the side and bottom wall structures 26, 27, 28 of the newspaper compartment 13 thereby circumscribing the front of the mailbox 11.

What is claimed is:

1. A mailbox, comprising:

a postal compartment with front and rear ends and including:

a longitudinally extending outer wall having laterally spaced upright segments and an arched segment between the upper ends of said upright segments, said upright segments and said arched segment each having an inner and outer surface, and a longitudinally extending inner wall having laterally spaced upright segments and an arched segment between the upper ends of said upright segments, said upright segments and said arched segment each having an inner and outer surface, said inner wall and said outer wall being spaced from one another, said arched segment of said inner wall including two rows of longitudinally spaced upwardly extending pockets adjacent the junctions, respectively, of said arched segment of said inner wall with said upright segments of said inner wall said pockets providing rigidity and strength to said arched segment of said inner wall, and a newspaper compartment directly attached to and beneath said postal compartment, said newspaper compartment and with open front and rear ends including:

a pair of longitudinally extending laterally spaced side wall structures extending between said front and rear ends, each said side wall structure having laterally spaced inner and outer upright walls, wherein said inner and said outer upright walls each have an inner and outer surface, a bottom wall structure extending between said front and rear ends having a horizontal inner wall interconnecting the lower ends of said inner upright walls and a horizontal outer wall interconnecting the lower ends of said outer upright walls, and a partial rear wall extending upwardly from said horizontal inner wall at said rear end, and terminating below the upper ends of said side wall structures said partial rear wall serving as a reinforcement and as an abutment for a newspaper placed in said newspaper compartment.

2. The mailbox of claim 1 wherein said postal and newspaper compartments include shoulders at said front ends defining a forward projecting lip encircling the front end of said mailbox.

3. A mailbox, comprising:

a postal compartment with front and rear ends, said front end having a door, said postal compartment including:

a longitudinally extending outer wall having laterally spaced upright segments and an arched segment between the upper ends of said upright segments, said upright segments and said arched segment each having an inner and outer surface, and a longitudinally extending inner wall having laterally spaced upright segments and an arched segment between the upper ends of said upright segments, said upright segments and said arched segment each having an inner and outer surface, said inner wall and said outer wall being spaced from one another, said arched segment of said inner wall including two rows of longitudinally spaced upwardly extending pockets adjacent the junctions, respectively, of said arched segment of said inner wall with said upright segments of said inner wall, said pockets providing rigidity and strength to said arched segment of said inner wall, and a floor secured to the lower ends of said upright segments of said inner wall.

4. A mailbox comprising:

a postal compartment, a newspaper compartment directly attached to and beneath said postal compartment, said newspaper compartment with open front and rear ends and including:

a pair of longitudinally extending laterally spaced side wall structures extending between said front and rear ends, each said side wall structure wherein said inner and said outer upright walls each have an inner and outer surface having laterally spaced inner and outer upright walls, a bottom wall structure extending between said front and rear ends having a horizontal inner wall interconnecting the lower ends of said inner upright walls and a horizontal outer wall interconnecting the lower ends of said outer upright walls, and a partial rear wall extending upwardly from said horizontal inner wall at said rear end and terminating below the upper ends of said side wall structures, said partial rear wall serving as a reinforcement and as an abutment for a newspaper placed in said newspaper compartment.

* * * * *